US005819414A

United States Patent [19]

Marifone

[11] Patent Number: 5,819,414

[45] Date of Patent: Oct. 13, 1998

[54] DOUBLE ACTION FOLDING KNIFE

[76] Inventor: Anthony L. Marifone, 1736 17th Pl. SW., Vero Beach, Fla. 32962

[21] Appl. No.: 994,197

[22] Filed: Dec. 19, 1997

[51] Int. Cl.[6] ..... B26B 1/04

[52] U.S. Cl. ..... 30/160; 30/161

[58] Field of Search ..... 30/159–161; D22/118

[56] References Cited

FOREIGN PATENT DOCUMENTS 28766 1/1884 Germany ..... 30/159

*Primary Examiner*—Douglas D. Watts
*Attorney, Agent, or Firm*—Carroll F. Palmer

[57] ABSTRACT

Folding knives having a longitudinal sheath handle with a channelled body portion into and out of which a blade pivots about an axis normal to a common plane of the handle and blade between a sheathed position within the handle through an arc to a use position external of the handle and a lock to automatically lock the blade in such use position upon completion of the unsheathing movement, which lock is manipulated for manual return of the blade from its use position to its sheathed position are improved by addition of a double action feature provided by an actuator unit that is cocked by manual rotation of the blade from the use position back into the sheathed position and a trigger to uncock the actuator unit for automatic quick forced rotation of the blade from its sheathed position all the way to its use position.

5 Claims, 5 Drawing Sheets

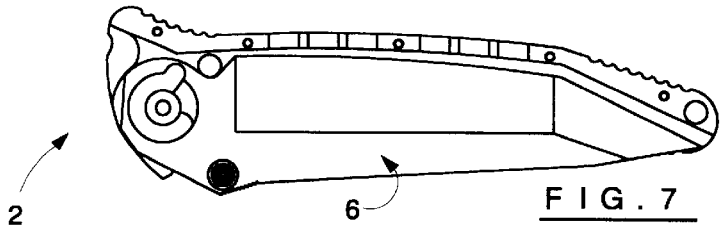
FIG. 7
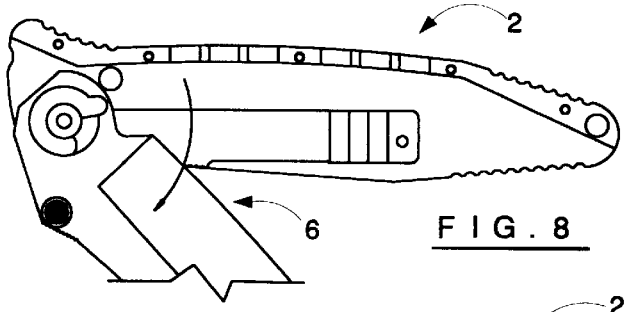
FIG. 8
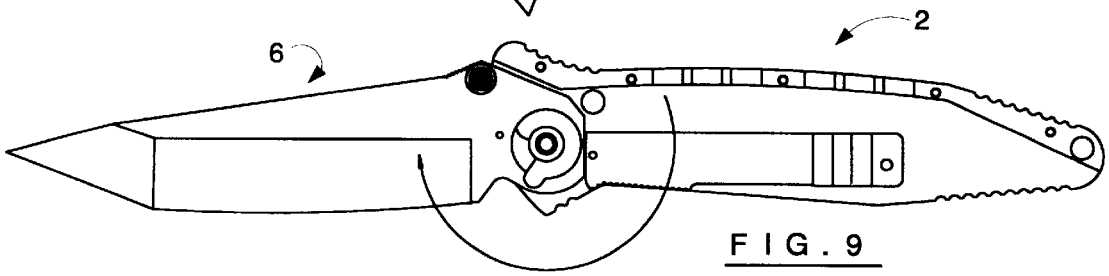
FIG. 9
FIG. 10
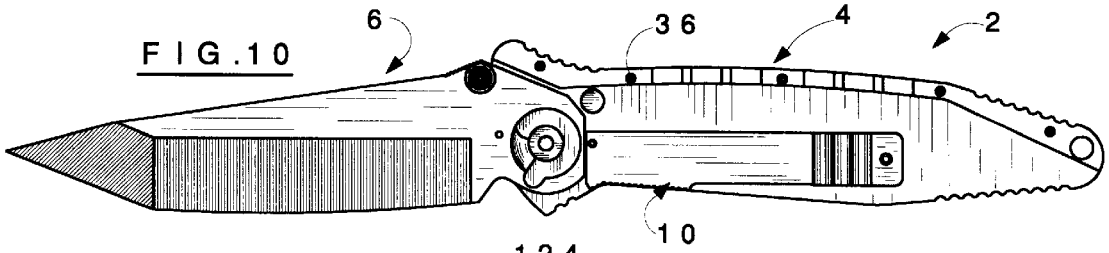
FIG. 11
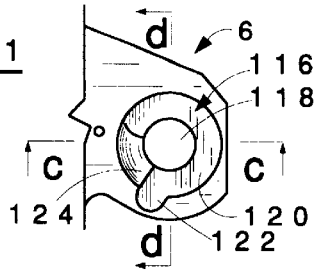
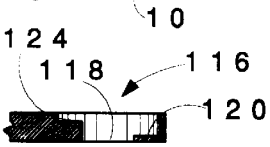
FIG. 12
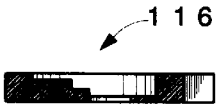
FIG. 13

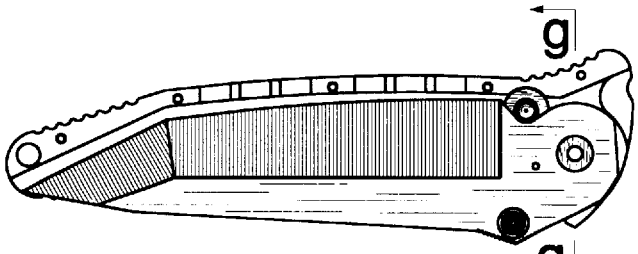
FIG.14
FIG.15
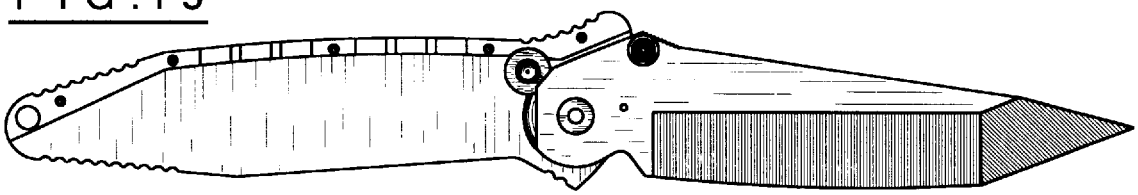
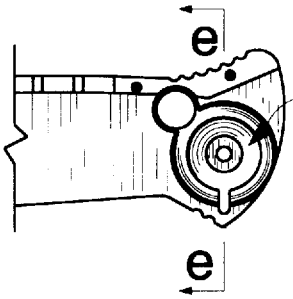
FIG.16
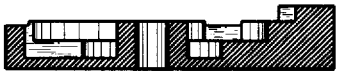
FIG.18
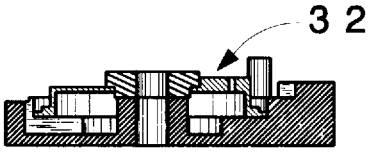
FIG.19
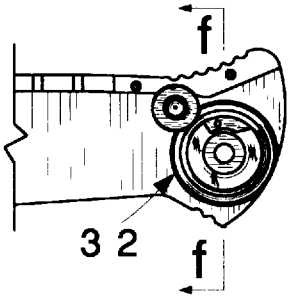
FIG.17
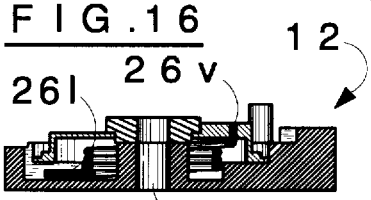
FIG.20
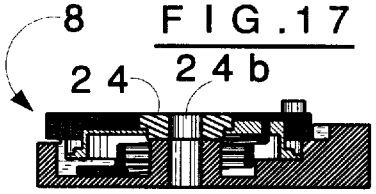
FIG.21
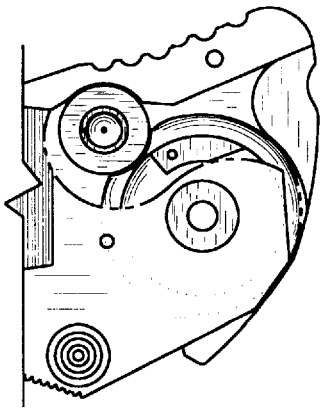
FIG.22
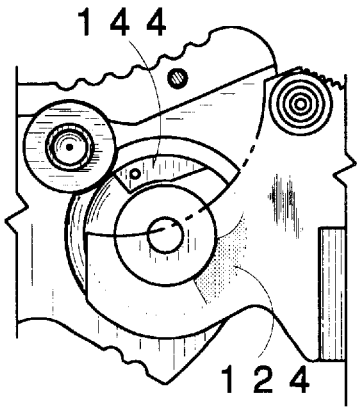
FIG.23
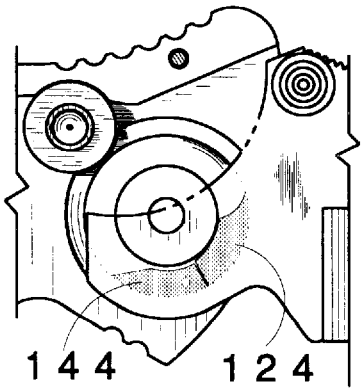
FIG.24

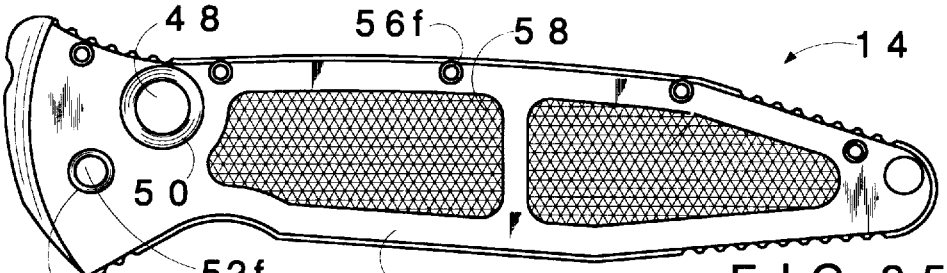
FIG. 25
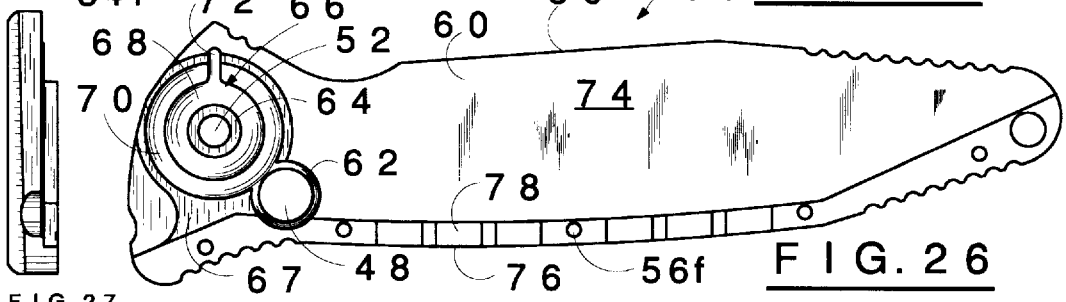
FIG. 26
FIG. 27
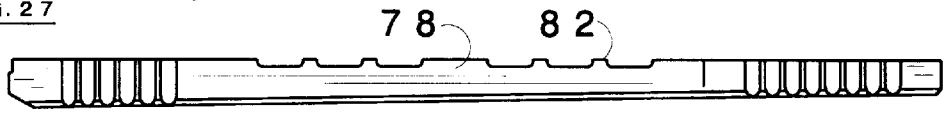
FIG. 28
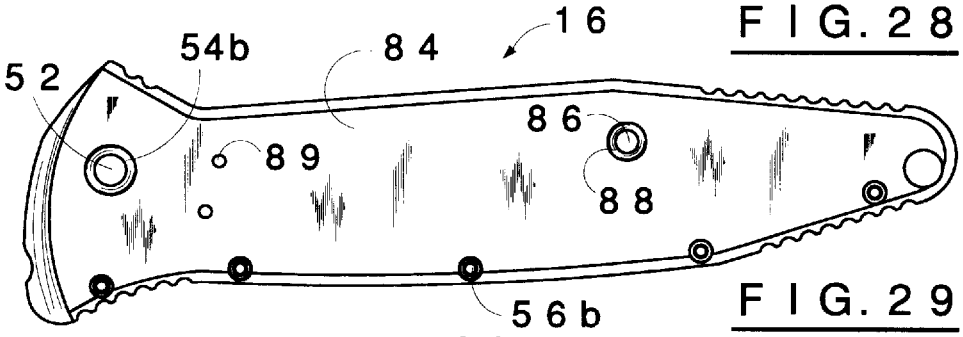
FIG. 29
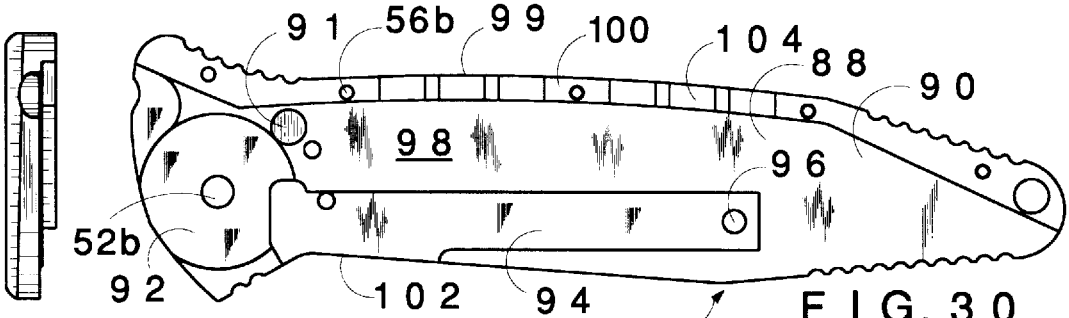
FIG. 30
FIG. 31
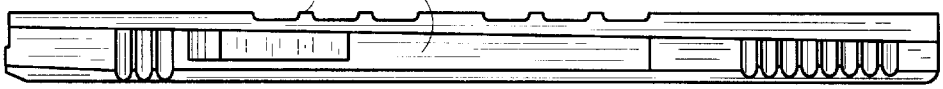
FIG. 32

20

22

24
24b

24l 26
26v
28f
28
28l
28b
26l 134
136
28
28s 138
130
136
134
a
144
146
b
140
142
32

144
134
132
30
30e 140
144
132
138
142

10

34
34n
34e
34b
34
10
34s
34p
34n

DOUBLE ACTION FOLDING KNIFE

BACKGROUND OF THE INVENTION

1. Field of the Invention

This application relates broadly to folding knives. More particularly, it concerns a new type of folding knife having a single blade that may be unsheathed from an encased safety position by two distinctly different actions, i.e., a double action folding knife.

2. Description of the Prior Art

Knives that have blades or other elements, e.g., a nail-file, that fold from a safety position to a unsheathed use position are universally known, e.g., so-called pocket knives, e.g., see U.S. Pat. No. 557,760. The present invention concerns a specific subclass of such knives to be identified herein and the accompanying claims by the term "folding knife", or its plural counterpart "folding knives", which shall mean a knife comprising an elongated sheath handle to which a single blade is pivoted at one end about an axis normal to the plane of the blade to unfold from a sheathed safety position to a locked fully exposed use position.

Folding knives can be contrasted to slide knives in which the blade slides between a sheathed position and an exposed position, e.g., see U.S. Pat. No. 5,029,354. They are also contrasted to holder knives in which the blade and its handle are housed in a separable sheath, e.g., see U.S. Pat. No. 4,426,779.

Folding knives within the above recited definition come in a great number of varieties, sizes and shapes, each usually designed to appeal to a specific type of user, e.g., hunting, fishing, personal defense, etc. In most, the blade is manually moved, i.e., simply by hand, from the sheathed position to exposed use position where it becomes locked typically by a spring unit, e.g., see U.S. Pat. Nos. 4,985,998, 5,009,008, 5,095,624 and 5,442,529. In some folding knives, the blade may be mechanically moved from the sheathed position to the use position, e.g., see U.S. Pat. Nos. 4,719,700 and 5,522,138.

The present invention provides a new type of folding knives in which the blade can be moved from the sheathed position to exposed use position (1) by user's tactile manipulation of the blade or (2) by user pressing a release button and without touching the blade, i. e., double action folding knives.

OBJECTS

A principal object of the invention is the provision of an improved type of folding knives.

Further objects are the provision of improved folding knives that:

1. Enable the user to move the blade from its sheathed position to locked use position in two different ways, i.e., that are double action knives.
2. Permit the blade to be snapped by spring action forceably all the way from the sheathed position to use position by simply pushing a button.
3. Alternatively, permit the blade to be moved manually and silently from the sheathed position to use position.
4. Comprise a unique pivoting system for the blade comprising a coiled torsion spring that enables such snap action spring to remain cocked when the blade is manually unsheathed, i.e., moved simply by hand into its use position.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of double action folding knives, i.e., folding knives in which the blade can be moved from its sheathed position to locked use position in two different ways, namely (1) snapped by trigger action from the sheathed position to use position by simply pushing a button or (2) moved manually and silently from the sheathed position to use position.

The improved folding knives of the invention comprise (a) a longitudinal sheath handle defined by a first end, a second end and a channelled body portion integrally joining the first and second ends, (b) a blade defined by a pivot end, a free end and an integral central body portion all lying in a common plane, the pivot end being pivoted to the handle first end about an axis normal to the common plane enabling the blade to move between a sheathed position within the handle through an arc to a use position external of the handle, (c) pivot means upon which the blade is pivoted enabling the blade to be manually moved between the sheathed position and the use position, (d) lock means to automatically lock the blade in the use position upon completion of the movement thereof into the use position and to be manually un locked for manual return of the blade from the use position to the sheathed position and (e) actuator means comprising a coiled torsion spring associated with the pivot means that is cocked by manual rotation of the blade from the use position to the sheathed position and can be manually uncocked for automatic rotation of the blade from the sheathed position to the use position.

In preferred embodiments, the actuator means comprises a sear drum and the pivot end of the blade contains a circular cavity wherein the sear drum is rotatably positioned. The circular cavity includes a first cam lug and the sear drum includes a second cam lug which upon rotation of the sear drum may engage the first cam lug to limit rotation of the sear drum relative to the circular cavity in the blade.

A coil spring defined by a first end and a second end is positioned between the circular cavity and the sear drum, such first end being restrained in the circular cavity and the second end being restrained by the sear drum whereby the second cam lug is biased by the spring to engage the first cam lug.

Further, the actuator means comprises a push button spring biased into trigger position to lock the sear drum against rotation within the circular cavity, which push button upon being depressed releases the sear drum for rotation within the circular cavity.

Manual rotation of the blade from the use position to the sheathed position compresses the coil spring while rotation of the sear drum allows the push button to return to the trigger position thereby cocking the coil spring for later uncocking by another depression of the push button.

Once the blade of the new double action folding knives has been moved to and locked in the use position, the blade is always manually returned to the sheathed position in the handle, i.e., there is no automatic return from use to sheathed position. However, this manual return will differ depending upon whether the blade was moved into the use position automatically or manually. Thus, if the knife blade is automatically unfolded into use position, the manual return into use position will require substantial hand pressure because the coil spring of the actuator means must be "cocked" as the blade is sheathed into the handle.

In contrast, when the blade is manually pivoted into use position from the handle, the coil spring remains "cocked" so the subsequent manual return of the blade back into the handle requires appreciably less manual pressure.

In either case of return, the knives of the invention provide a mild detente action to ensure that the blade once moved into the sheathed position will safely remain there until manually or automatically moved into the use position, e.g., the knife blade will not fall out of the handle when the knife is turned so the sheath slot of the handle faces downward.

BRIEF DESCRIPTION OF THE DRAWINGS

A more complete understanding of the invention can be obtained by reference to the accompanying drawings in which generic parts of the illustrated matter are indicated by arrowhead lines associated with the designation numerals while specific parts are indicated with plain lines associated with the numerals and wherein:

FIG. 7 is a diagrammatic view of a folding knife of the invention with the blade in its sheathed position and with the front half of the handle removed.

FIG. 8 is a diagrammatic view similar to FIG. 7 with the blade partially unfolded from its sheathed position in the direction of the arrow.

FIG. 9 is a diagrammatic view similar to FIG. 7 with the blade fully unfolded into its locked use position.

FIG. 10 is a detailed view similar to diagrammatic view FIG. 9.

FIG. 11 is a fragmentary plan view of the pivot end of the knife blade shown in FIG. 10.

FIG. 12 is a sectional view taken on the line "c—c" of FIG. 11.

FIG. 13 is a sectional view taken on the line "d—d" of FIG. 11.

FIG. 14 is a plan view of the back side of a knife of the invention with the back half of the handle removed and with the blade in its folded, sheathed position.

FIG. 15 is a plan view of the back side of a knife of the invention similar to FIG. 14, but with the blade in its unsheathed use position.

FIG. 16 is a fragmentary view similar to FIG. 15, but with the knife blade removed.

FIG. 17 is a fragmentary view like FIG. 15, but with the shear drum and trigger button of the blade actuator means of the knife in their installed positions.

FIG. 18 is a sectional view taken on the line "e—e" of FIG. 16.

FIG. 19 is a sectional view taken on the line "f—f" of FIG. 17.

FIG. 20 is a sectional view similar to FIG. 19, but with the blade actuator means coil spring in position under the shear drum.

FIG. 21 is a sectional view similar to FIG. 20, but with the knife blade in position over the shear drum.

FIG. 22 is an enlarged, fragmentary view of the right hand section of FIG. 14.

FIG. 23 is an enlarged, fragmentary of the central section of FIG. 15 showing a cam element on the knife blade in phantom when the blade has been manually unfolded into its unsheathed position.

FIG. 24 is an enlarged, fragmentary of the central section of FIG. 15 showing both the cam element on the knife blade and a cam portion of the sear drum in phantom when the blade has been unfolded into its unsheathed position by depression of the trigger button.

FIG. 25 is a obverse view of the front half of the handle of a knife of the invention.

FIG. 26 is a reverse view of the front half of the handle of a knife of the invention.

FIG. 27 is the end view of the handle shown in FIG. 25.

FIG. 28 is a lateral view of the front half of the handle as seen in FIG. 26.

FIG. 29 is a obverse view of the back half of the handle of a knife of the invention.

FIG. 30 is a reverse view of the back half of the handle of a knife of the invention.

FIG. 31 is the pivot end view of the handle shown in FIG. 30.

FIG. 32 is a lateral view of the back half of the handle as seen in FIG. 30.

DESCRIPTION OF THE PREFERRED EMBODIMENTS

Figure 1:
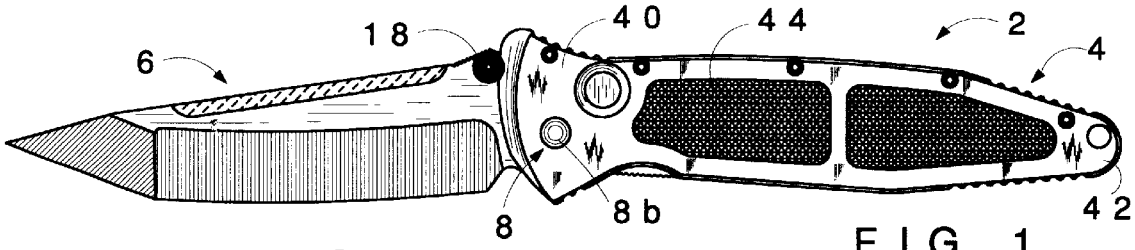
FIG. 1 is a plan view of the front side of a folding knife of the invention with its blade in the locked, unsheathed use position.
Figure 2:
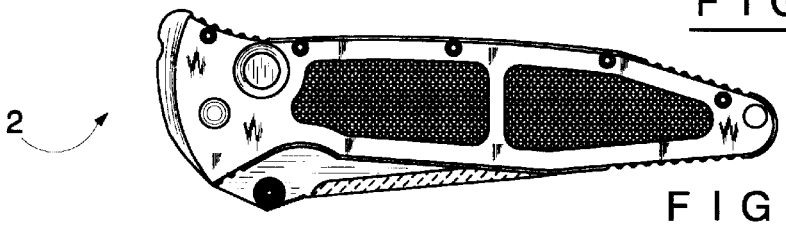
FIG. 2 is a plan view of the front side of the folding knife of FIG. 1 with its blade in the folded, sheathed position.

With reference in detail to the drawings, the double action folding knife 2 of the invention basically comprises a longitudinal sheath handle 4, a blade 6, pivot means 8, lock means 10 (FIG. 10) and actuator means 12 (FIGS. 20 & 21). The handle 4 consists of a front half 14 (FIGS. 25 & 26) plus a back half 16 (FIGS. 29 & 30) and the blade 6 includes a stop unit 18.

With reference to FIGS. 33–53 of the drawings, specific parts of the knife 2 include first stud 20 and second stud 22 of a blade stop unit 18, ring bushing 24 with bore 24*b*, coil spring 26, trigger button 28, trigger spring 30, sear drum 32 and lock element 34 of lock means 10.

In addition, the knife 2 includes a variety of screws and like fasteners 36 not specifically illustrated to hold parts in position and a belt clip 38.

The longitudinal sheath handle 4 is defined by a first end 40, a second end 42 and a channelled body portion 44.

As seen in FIG. 25, the obverse side 46 of front half 14 of handle 4 comprises a bore 48 with concentric front ledge 50, a smaller bore 52 with concentric front ledge 54*f*, a plurality of screw holes 56*f* and anti-slip surfacing 58.

As seen in FIG. 26, the reverse side 60 of front half 14 of handle 4 comprises the bore 48 with concentric back ledge 62, the smaller bore 52 with concentric, elevated back ledge 64, the screw holes 56*f* and a circular cavity 66 surrounded by peripheral ledge 67. The cavity 66 has an inner depressed ring bottom 68 and a outer elevated ring ledge 70. A slot 72 extends through ledge 67 and ring 70.

A major area of the reverse side 60 is plateau 74 defined at one side 76 by the wall 78 with the other side 80 forming a slot in the handle 4 through which the blade 6 folds and unfolds as illustrated in FIGS. 7–9. Ridges 82 in the wall 78 provide ventilation for the interior of the handle 4.

As seen in FIG. 29, the obverse side 84 of back half 16 of handle 4 comprises bore 52*b* with concentric ledge 54*b*, a smaller bore 86 with concentric ledge 88, a pair of screw holes 89 and a plurality of screw holes 56*b*.

As seen in FIG. 30, the reverse side 90 of back half 16 of handle 4 comprises a small circular cavity 91, screw holes 56*b*, a bore 52*b* surrounded by peripheral ledge 92, a contoured depression 94 corresponding general in shape to the spring element 34 and a screw hole 96.

A major area of the reverse side 90 is plateau 98 defined at one side 99 by the wall 100 with the other side 102 forming a slot in the handle 4 through which the blade 6 folds and unfolds as illustrated in FIGS. 7–9. Ridges 104 in the wall 100 provide ventilation for the interior of the handle 4.

Figure 5:
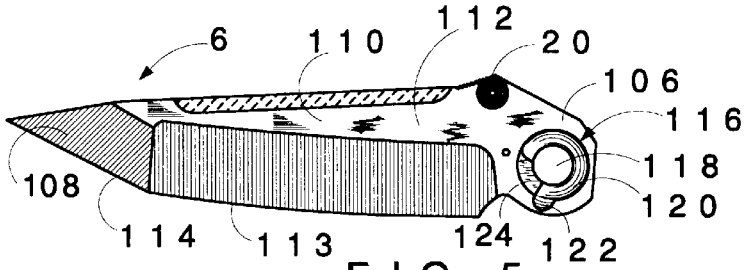
FIG. 5 is a plan view of the front side of the blade of the folding knife of FIG. 1.
Figure 6:
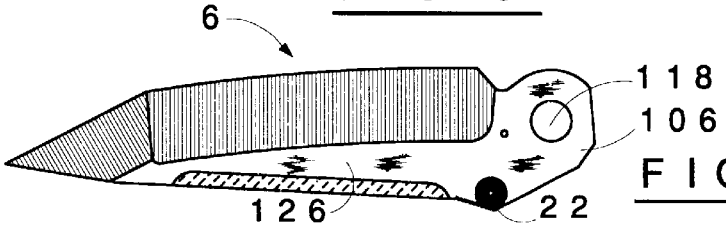
FIG. 6 is a plan view of the back side of the blade of the folding knife of FIG. 1.
Figures 33, 34, 35, 36, 37, 38, 39, 40, 41, 42, 43, 44, 45, 46, 47, 48, 49, 50, 51, 52, 53:
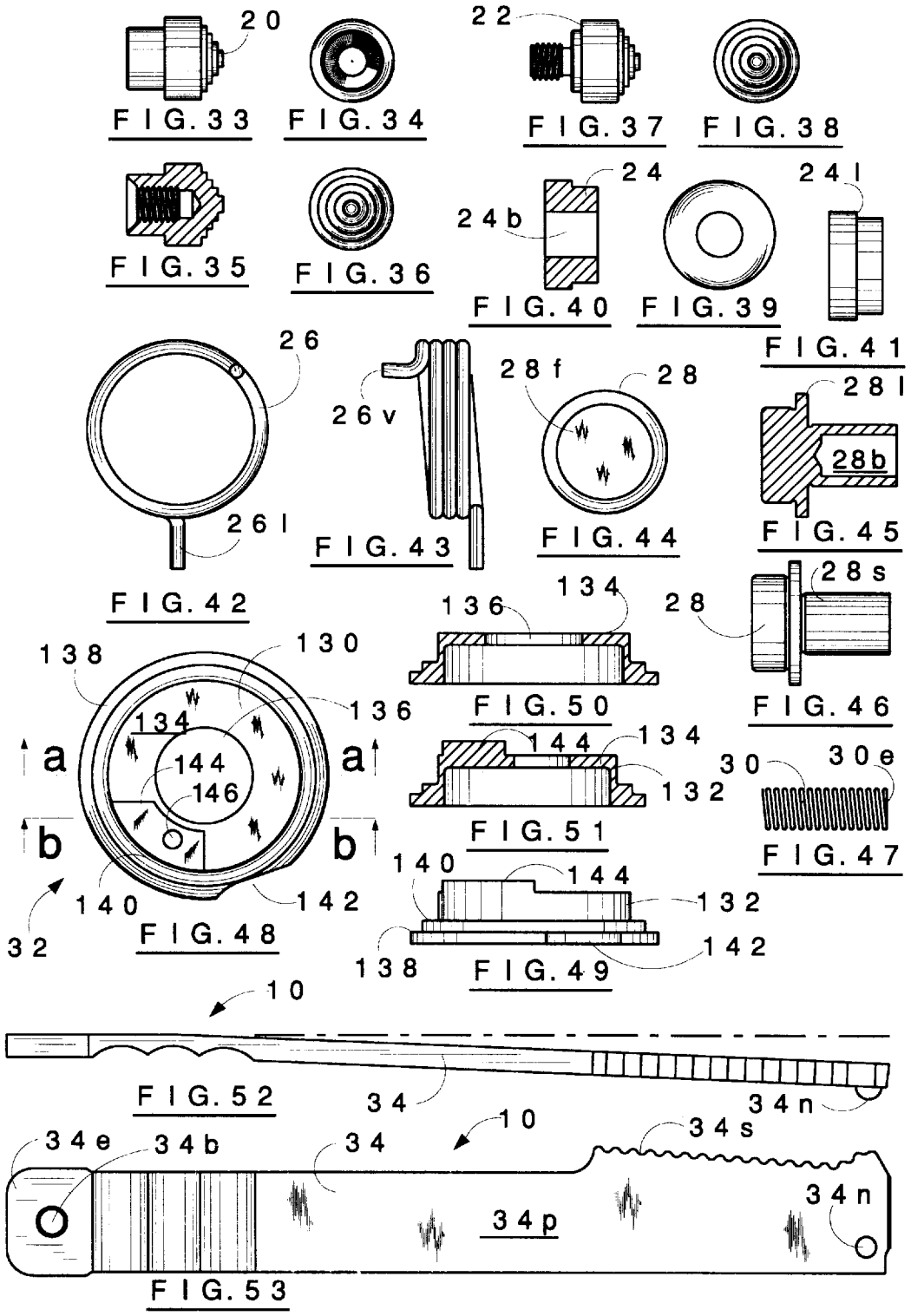
FIGS. 33–36 are lateral, bottom, sectional and top views, respectively, of the first stud of a blade stop unit of the knives of invention.
FIGS. 37 & 38 are lateral and top views, respectively, of the second stud of the blade stop unit.
FIGS. 39–41 are top, sectional and lateral views, respectively, of a ring bushing of the knives of invention.
FIGS. 42 & 43 are top and lateral views, respectively, of the coil spring shown in FIGS. 20 & 21.
FIGS. 44–46 are top, sectional and lateral views, respectively, of the actuator button for the knife of the invention.
FIG. 47 is a plan view of the return spring for the actuator button.
FIGS. 48 & 49 are plan and lateral views, respectively, of the sear drum show in FIG. 17.
FIG. 50 is a sectional view taken on the line "a—" of FIG. 48.
FIG. 51 is a sectional view taken on the line "b—" of FIG. 48.
FIG. 52 is a lateral view of the use position lock element of knives of the invention.
FIG. 53 is a plan view of the lock element of FIG. 52.

As shown in FIGS. 5 & 6, the blade 6 is defined by a pivot end 106, a free end 108 and an integral central body portion 110 all lying in a common plane. Such pivot end 106 is pivoted, in a manner described in detail below, to first end 40 of handle 6 about an axis normal to such common plane enabling blade 6 to move between a sheathed position (see FIG. 7) within said handle through an arc (see FIG. 8) to a use position (see FIG. 9) external of the handle 6.

As seen in FIG. 5, the obverse face 112 of blade 6, from which stud 20 projects, comprises cutting edges 113 & 114 and a circular cavity 116 (detailed in FIGS. 11–13) having a central bore 118 and a concentric ring ledge 120 containing a side entering slot 122. A contoured cam lug 124 upthrusts from the ring ledge 120.

As seen in FIG. 6, the reverse face 126 of blade 6 comprises bore 118 and projecting stud 22.

Figure 3:
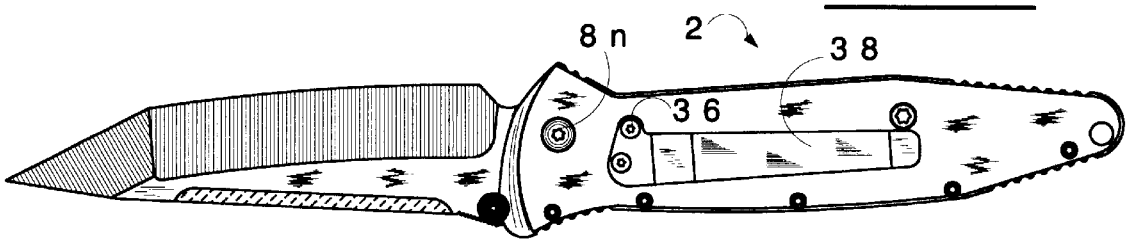
FIG. 3 is a plan view of the back side of the folding knife of the invention with its blade in the locked, unsheathed position.
Figure 4:
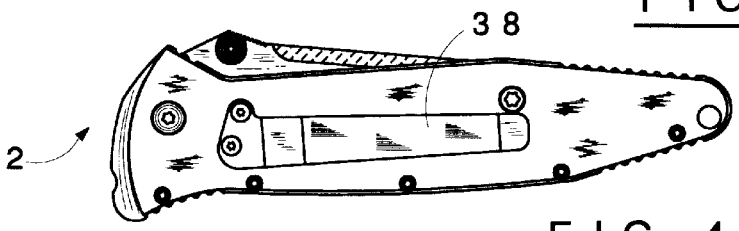
FIG. 4 is a plan view of the back side of the folding knife of FIGS. 1 & 3 with its blade in the sheathed position.

Pivot means 8 upon which blade 6 is pivoted between sheathed and use positions (see FIG. 21) comprises a combination of circular cavity 66, circular cavity 116, sear drum 32, bushing 24, back ledge 64 and a fastener, consisting of bolt 8*b* (FIG. 1) and nut 8*n* (FIG. 3), that extends, in turn, though bore 52*f*, bore 52*f*, bore 24*b* and bore 52*b*.

Lock means 10 to automatically lock blade 6 in its use position upon completion of movement thereof into such use position and from which the blade 6 is manually unlocked for manual return of from the use position to the sheathed position comprises the contoured lock element 34 having its support end 34*e* angled relative to the elongated body portion 34*p*. Lock element 34 includes edge serrations 34*s*, bore 34*b* and a projecting nib 34*n*. The nib 34*n* helps to reduce friction between element 34 and blade 6 during their relative movements plus serving to provide a retention feature for the blade 6 when fully located in its sheathed position. It will be apparent that the lock element 34 is easily moved into the unlocking position by downward pressure of the thumb on one hand of the user of the knife 2 against the serrations 34*s* while pressure is applied by the other hand of the user to rotate the blade back into its sheathed position.

The actuator means 12 that is cocked by manual rotation of said blade 6 from use position to sheathed position and can be manually uncocked for automatic rotation of blade 6 from sheathed position to use position provides the double action feature in the new knives of the invention. Sear drum 32 and trigger button 28 are essential parts of actuator means 12.

With reference to FIGS. 48–51, sear drum 32 comprises an inverted dish-like body 130 defined by a ring 132 capped by a concentric web 134 containing a central bore 136. An outer ledge 138 and an inner ledge 140 project laterally from the ring 132. The outer ledge 138 contains an arcuate recess 142. A cam lug 144 upthrusts from web 134 and contains a bore 146.

With reference to FIGS. 44–47, trigger button 28 comprises a pressure face 28*f*, a transverse ledge 281 and a dependent tubular section 28*s* containing a bore 28*b*. When button 28 is installed in knife 2, its face 28*f* extends through bore 48 so the ledge 281 engages back ledge 62. Also, the spring 30 is carried in bore 28*b* and one of its ends 30*e* will bear on cavity 90 to bias button 28 into such back ledge 62 engagement.

Reference is made to FIGS. 14–24 for an understanding of the construction and operation of actuator means 12 which comprises a combination of sear drum 32, handle cavity 66, blade cavity 116, coil spring 26 and trigger button 28.

As seen in FIGS. 17 & 19, sear drum 32 can slip concentrically into the handle cavity 66. However, before this is done, coil spring 26 is fitted into ring 68 of cavity 66 so that its lateral end 261 lodges in slot 72 while its vertical end 26*v* projects into bore 146 of sear drum 32 (see FIG. 20). Then, when sear drum 32 is positioned over spring 26 and in cavity 66, bushing 24 is positioned so its bore 24*b* aliens with cavity bore 52 while ledge 241 engages web 134 of sear drum 32 with bushing 24 extending through sear drum bore 136. Blade 6 is then positioned (see FIG. 21) so that its cavity 166 envelopes sear drum 32 with blade bore 118 encircling bushing 24.

With the foregoing description, it will be apparent that the double action folding knife 2 includes a circular cavity 116 that includes a first cam lug 124 and a sear drum 32 that includes a second cam lug 144. With reference to FIG. 24, upon rotation of sear drum 32 by depression of the trigger button 28 so that it disengages arcuate recess 142, second cam lug 144 will engage first cam lug 124 to limit rotation of sear drum 32 relative to circular cavity 116 and blade 6.

Thus, the cam lug 144 of the sear drum 32, when the spring 26 is uncocked by depression of the trigger button 20, will engage the cam lug 124 of the blade 6 thereby rotating the blade 6 until it comes to a stop in its use position and is locked by the lock means 10.

When the blade 6 is returned manually from the use position, the cam lug 124 will move with the blade 6 and push the cam lug 144 of the sear drum 32 back into the sheathed position whereupon the spring 30 will return the trigger button 28 into the recess 142 to thereby lock the sear drum 32 so the spring 26 remain cocked (see FIG. 23) until the trigger button is again depressed. Such cocking of the sear drum 32 and the spring 26 will exist regardless of how many times the blade 6 may be moved manually back and forth from the sheathed position and the use position.

The actuator means of the new knives of the invention provides them with a double action blade movement from sheathed position to locked use position. Thus, such means permits the blade to be snapped by spring action from the sheathed position to use position by simply pushing a button. Alternatively, it permits the blade to be moved manually and silently from the sheathed position to use position.

I claim:

1. A double action folding knife comprising:

a longitudinal sheath handle defined by a first end, a second end and a channelled body portion integrally joining said first and second ends, a blade defined by a pivot end, a free end and an integral central body portion all lying in a common plane, said pivot end being pivoted to said handle first end about an axis normal to said common plane enabling said blade to move between a sheathed position within said handle through an arc to a use position external of said handle, pivot means upon which said blade is pivoted enabling said blade to be manually moved between said sheathed position and said use position, lock means to automatically lock said blade in said use position upon completion of said movement thereof into said use position and to be manually unlocked for manual return of said blade from said use position to said sheathed position, actuator means associated with said pivot means comprising a coiled torsion spring that is cocked by manual rotation of said blade from said use position to said sheathed position and can be manually uncocked for automatic rotation of said blade forceably throughout movement from said sheathed position to said use position, and said blade comprises a circular cavity that includes a first cam lug and said actuator means includes a sear drum having a second cam lug which upon rotation of said sear drum may engage said first cam lug to limit rotation of said sear drum relative to said blade.

2. The double action folding knife of claim 1 wherein said coiled torsion spring is defined by a first end and a second end, which spring is positioned between said circular cavity and said sear drum, said first end being restrained in said circular cavity and said second end being restrained by said sear drum whereby said second cam lug is biased by said spring to engage said first cam lug.

3. A double action folding knife of claim 2 wherein said actuator means comprises a push button spring biased into trigger position to lock said sear drum against rotation within said circular cavity, which push button upon being depressed releases said sear drum for rotation within said circular cavity.

4. A double action folding knife of claim 3 wherein manual rotation of said blade from said use position to said sheathed position compresses said coil spring while rotating said sear drum to allow said push button to return to said trigger position thereby cocking said coil spring for later uncocking by another depression of said push button.

5. In a folding knife having a longitudinal sheath handle defined by a first end, a second end and a channelled body portion integrally joining said first and second ends, a blade defined by a pivot end, a free end and an integral central body portion all lying in a common plane, said pivot end being pivoted to said handle first end about an axis normal to said common plane enabling said blade to pivot between a sheathed position within said handle through an arc to a use position external of said handle and lock means to automatically lock said blade in said use position upon completion of said movement thereof to said use position and to be unlocked for manual return of said blade from said use position to said sheathed position, the improvement of a double action feature comprising:

actuator means that is cocked by manual rotation of said blade from said use position to said sheathed position, trigger means to uncock said actuator means for automatic rotation of said blade forceably throughout movement from said sheathed position to said use position, and cam means that enables said double action whereby said blade is selectively moved from said sheathed position to said use position (1) by user's tactile manipulation of the blade while said actuator means remains cocked or (2) by user, without touching said blade, pressing said trigger means to uncock said actuator means.

* * * * *